United States Patent [19]

Swan et al.

[11] 4,004,967

[45] Jan. 25, 1977

[54] BLEACHING CELLULOSE PULP WITH OXYGEN IN THE PRESENCE OF FORMALDEHYDE

[75] Inventors: Brita Swan; Rune Gustavsson, both of Saffle, Sweden

[73] Assignee: Billeruds Aktiebolag, Saffle, Sweden

[22] Filed: July 2, 1975

[21] Appl. No.: 592,510

Related U.S. Application Data

[63] Continuation of Ser. No. 521,873, Nov. 7, 1974, abandoned, which is a continuation of Ser. No. 370,608, June 18, 1973, abandoned.

[30] Foreign Application Priority Data

June 22, 1972 Sweden ..... 8288/72

[52] U.S. Cl. ..... 162/65; 8/111; 162/72; 162/77

[51] Int. Cl.[2] ..... D21C 9/10

[58] Field of Search ..... 162/65, 84, 72, 86, 162/76, 77, 90; 8/111

[56] References Cited

UNITED STATES PATENTS

| | | | |
|---|---|---|---|
| 2,022,664 | 12/1935 | Groombridge et al. | 162/77 |
| 3,652,385 | 3/1972 | Noreus et al. | 162/65 X |
| 3,668,063 | 6/1972 | Engstrom | 162/65 X |
| 3,703,435 | 11/1972 | Schleinkofer | 162/65 X |

*Primary Examiner*—S. Leon Bashore
*Assistant Examiner*—Arthur L. Corbin
*Attorney, Agent, or Firm*—Toren, McGeady and Stanger

[57] ABSTRACT

When bleaching wood pulp with oxygen the result can be improved if formaldehyde, methanol, ethanol, isopropanol, glycerol, sorbitol, formic acid, or acetone is added to the pulp.

10 Claims, 3 Drawing Figures

BLEACHING CELLULOSE PULP WITH OXYGEN IN THE PRESENCE OF FORMALDEHYDE

This is a continuation of Application Ser. No. 521,873 filed on Nov. 7, 1974 now abandoned, which is a continuation of Ser. No. 370,608 filed on June 18, 1973, now abandoned.

The invention relates to the bleaching of cellulose pulp by treating it with oxygen in the presence of alkali so as to remove lignin from the pulp. The treatment is primarily intended for pulp which has been obtained in known manner by digesting a woody plant material so that a first lignin reduction is obtained. The treatment according to the invention then gives a semi-bleached pulp, after known additional treatment, or acts as a preparatory bleaching stage when full bleaching is desired.

Lignin can be effectively and selectively removed using bleaching agents containing chlorine, but these bleaching agents produce spent liquors which are difficult or practically impossible to make innocuous. Increased requirements for improved environmental care have therefore brought to the fore the use of oxygen which might eliminate said problem. However, this bleaching agent is less selective and can therefore only be used for partial lignin removal. The cellulose is strongly affected, especially when the lignin content is low, and the oxygen treatment must therefore be stopped relatively soon. Both with respect to ecomomy and environmental protection, it is important to continue the lignin removal as far as possible, i.e. to reduce the break-down rate of the cellulose in relation to that of the lignin. In theory there are many possibilities of this, for example, the use of complex binders which directly or indirectly reduce the effects of catalytically active heavy metals or radical catchers, such as phenols, amines, etc. In practice, noticeable effect has been achieved by washing the cellulose pulp with acid prior to the oxygen treatment, which partially removes heavy metals. An easier possibility was discovered some decade ago when it was discovered and a good result was achieved by the addition of magnesium salts. However, the effect of these two processes is relatively limited even under the most favourable conditions. Furthermore, washing with acid is expensive to perform on a production scale whereas the magnesium salts may be difficult to distribute, especially in larger quantities. Disturbances may also result in the recovery system.

It has now been found that the problems mentioned can be reduced, and that the selectivity can be considerably improved, by adding formaldehyde to the process. Substances which react in a similar manner, for example methanol, ethanol, isopropanol, glycerol, sorbitol, formic acid and acetone, have also given equally good results. Satisfactory results have been obtained with methanol in combination with formaldehyde or formic acid. A magnesium salt, preferably magnesium sulphate, should preferably be added to the pulp. A preferred quantity is 0.5 – 2.0 kg per ton of pulp, defined as magnesium.

Figure 1:
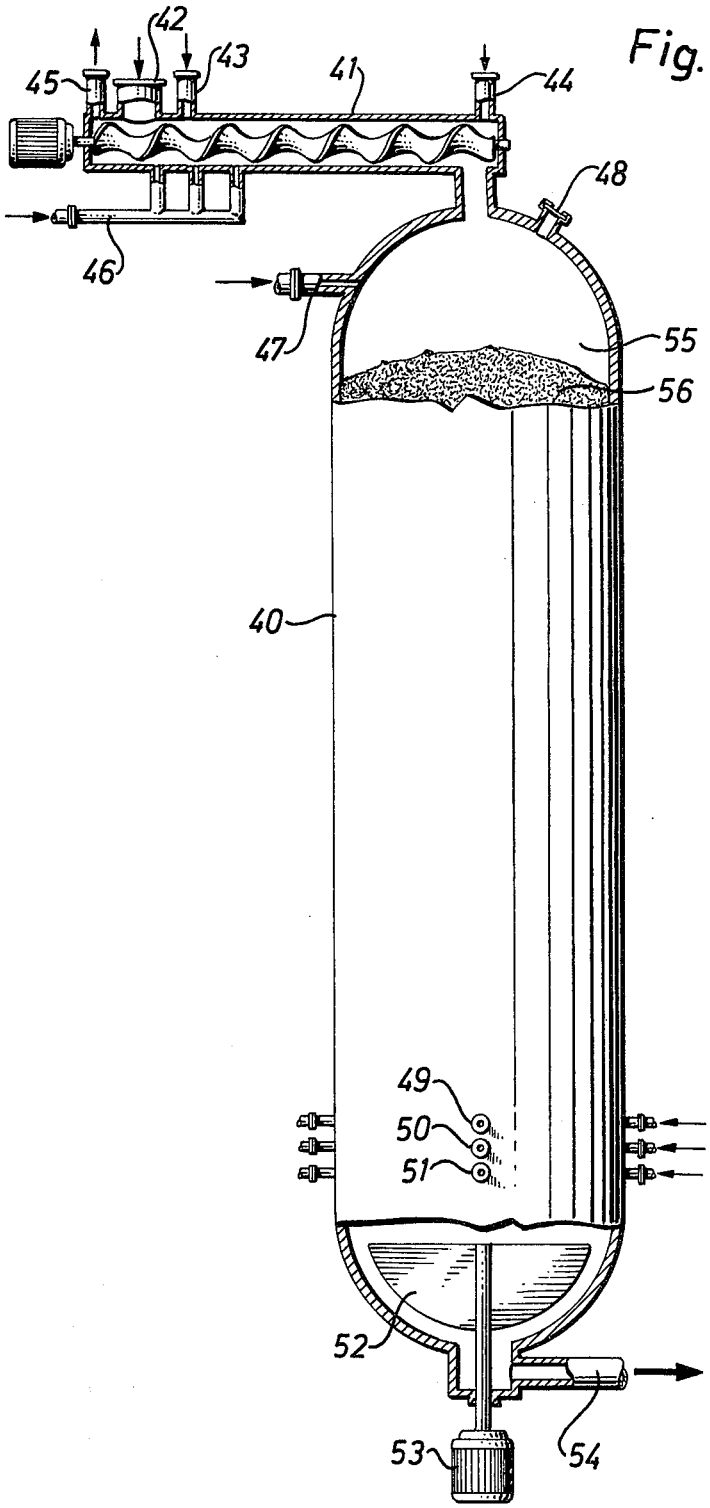
Figure 2:
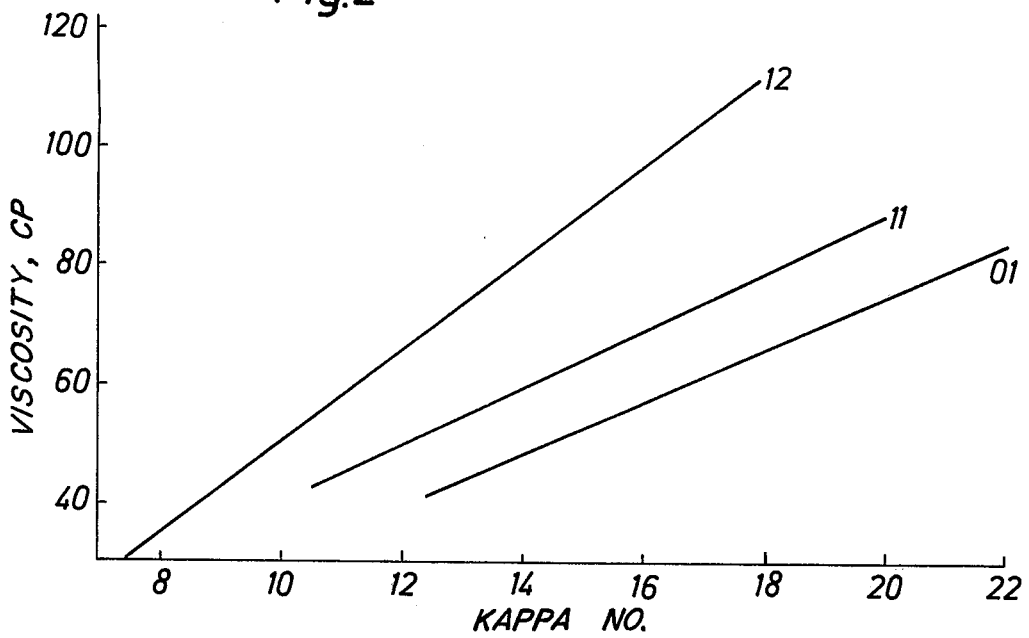
Figure 3:
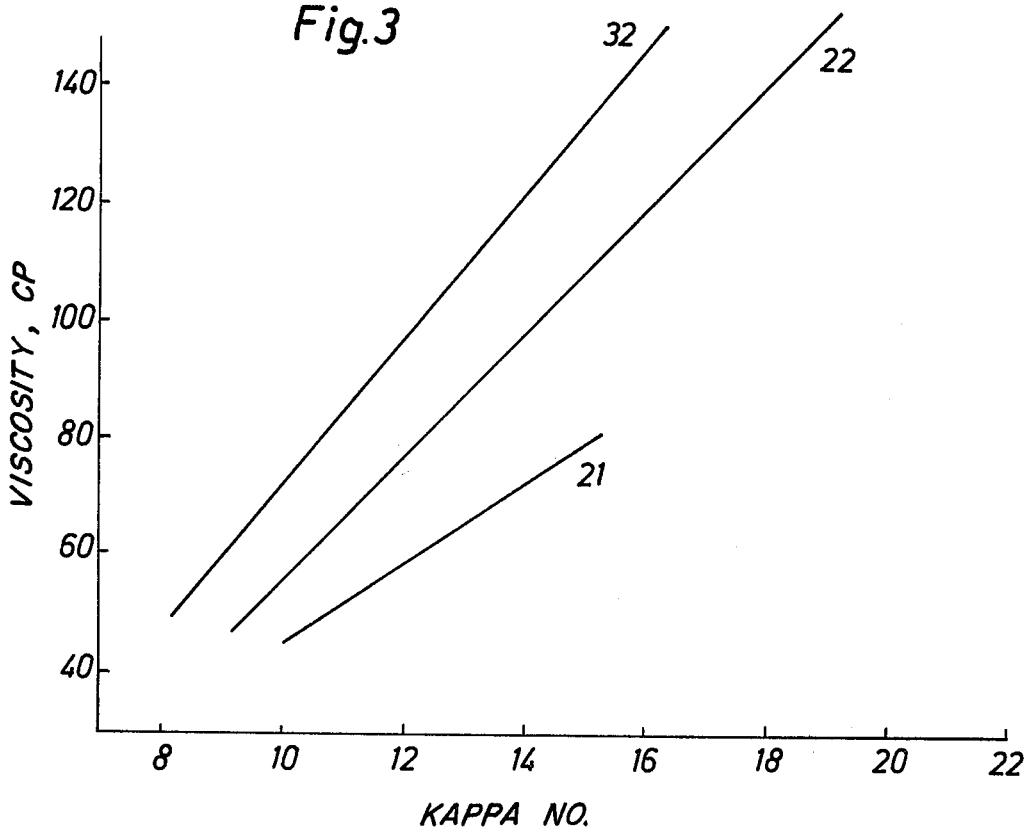

The invention will now be described with reference to the accompanying drawings. FIG. 1 illustrates an apparatus for bleaching wood pulp. FIGS. 2 and 3 are diagrams illustrating the relation between the kappa number and the viscosity.

The apparatus of FIG. 1 comprises an upright cylindrical vessel 40. The top of the vessel communicates with a combined feeder and mixer 41. Wood pulp is supplied to the feeder through a wide pipe 42. The pulp generally has a solids content of 25 to 35 % and preferably 30 % by weight. Formaldehyde is added through a pipe 43, oxygen through a pipe 44, and steam through a pipe 46. The alkali required for the process may be added to the mixer 41, but it is preferred that the alkali has been added in a previous step, not illustrated. Generally, the pulp contains 10 to 100 kg. of alkali per ton of pulp. Unreacted gases are allowed to escape through a pipe 45. Water can be sprayed into the top portion 55 of the vessel through a pipe 47. A wide pipe in the top of the vessel is closed by a thin metal sheet 48, which breaks at a pre-determined internal pressure, thus acting as a safety valve. The pressure may increase through the ignition of the pulp, because wood pulp having a solids content of more than 35 % by weight may catch fire in an environment of oxygen, particularly at a high pressure. As an alternative, formaldehyde and oxygen may be supplied through pipes 49, 50 in the bottom portion of the vessel, i.e., during the final stage of the bleaching. The bottom portion of the vessel also contains pipes 51 for the supply of water, so as to reduce the solids content of the pulp, to 3 to 5 % and preferably to approximately 4 % by weight. A mixer 52, driven by a motor 53, produces a homogeneous pulp, which leaves the vessel through a pipe 54.

The diagram of FIGS. 2 and 3 contain lines defined by numbers. Said numbers correspond to the series numbers given in the tables disclosing the results of the examples below. When studying the examples, it should be kept in mind that the effect of the formaldehyde is dependent on how the cellulose pulp has been treated previously. The treatment has therefore been performed on two sulphate pulps having different viscosity, the quantity of magnesium added also being altered. Washing in acid is not of the same importance, inter alia because it is normally difficult to perform on an industrial scale, and also because the same result can be obtained in other ways. Example 3, however, shows the results which can be achieved when the additives are used on a pulp which has previously been well washed with $SO_2$. If washing with acid is practically feasible it is of course desirable. Generally, the temperature of the pulp is 80° to 120° C and the pressure in the column is from 0.5 to 1.5 MPa.

The quantities of the chemicals referred to below are given as kilograms (kg) per ton of dry pulp. All tons are metric tons.

EXAMPLE 1

Unbleached pine sulphate pulp having a kappa number 33.3 and viscosity 167 cP according to Tappi was oxygen-bleached with the addition of 0.46 kg magnesium per ton of pulp and varying quantities of other chemicals.

The pulp was ground in a propeller grinder at a solids content of 30 % by weight. A solution of magnesium sulphate was mixed in, whereupon the pulp concentration dropped to about 12 %. The pulp was divided into samples for various experimental series. Varying quantities of caustic soda solution, formaldehyde and water were added to the samples so that an 8 % concentration was obtained. The pulp was then pressed to a solids content of 30 % by weight and was granulated by hand. After this treatment 0.46 kg magnesium per ton pulp was added to the samples as well as varying quantities of sodium hydroxide and formaldehyde, or equivalent substances, in accordance with Table 1.

TABLE 1

| Series | Additive Substance | Additive kg | Sodium hydroxide batch kg | Sodium hydroxide Consump. kg | Kappa No. | Viscosity Tappi cP | Brightness Scan % |
|---|---|---|---|---|---|---|---|
| 11 | — | | 20 | 13 | 14.5 | 62 | 38.4 |
| | | | 40 | 26 | 10.0 | 40 | 46.9 |
| | | | 60 | 33 | 8.3 | 29 | 53.8 |
| 12 | Form-aldehyde | 9 | 20 | 16 | 16.9 | 102 | 40.2 |
| | | | 40 | 30 | 11.1 | 59 | 49.0 |
| | | | 60 | 40 | 8.8 | 41 | 55.6 |
| 13 | " | 3 | 40 | 28 | 10.6 | 49 | 44.9 |
| 14 | " | 6 | 40 | 29 | 10.8 | 52 | 46.2 |
| 15 | " | 24 | 40 | 34 | 14.3 | 88 | 41.6 |
| | | | 60 | 44 | 10.8 | 60 | 48.7 |
| | | | 100 | 51 | 8.0 | 38 | 56.6 |
| 16 | Form-aldehyde+ | 4.5 | | | | | |
| | Methanol | 4.7 | 40 | 25 | 10.5 | 50 | 47.8 |
| 17 | Methanol | 9.4 | 40 | 22 | 9.7 | 43 | 49.2 |
| 18 | Sorbitol | 27 | 40 | 21 | 9.7 | 48 | 51.4 |

The oxygen treatment was performed in autoclaves holding 2 liters which were filled at room temperature (22° C) to a pressure of 1 MPa (Megapascal, 1 Pa being 1 Newton per square meter.). They were immersed in a glycol bath having a temperature of 100° C for 90 min., 45 min. being needed to attain full temperature. After completed treatment the pressure was 1.0 – 1.4 MPa at 100° C. The pulp was now diluted with distilled water to 4.3 % pulp concentration and was leached for 16 – 18 hours. The remaining alkali was determined by means of acid titration using phenolphthalein as indicator.

The pulp was now diluted to about 0.5 % concentration, defibred and neutralised with acetic acid to a pH value of 6.5. The liquid was filtered off and the pulp cake was washed thoroughly with distilled water and analysed as to kappa number, viscosity and brightness. The results are shown in Table 1.

EXAMPLE 2

Unbleached pine sulphate pulp having a kappa number of 34.7 and particularly high viscosity, somewhat more than 180cP (1265 $cm^3/g$ according to Scan), was oxygen bleached using 0.92 kg magnesium per ton pulp and varying quantities of chemicals.

Otherwise the bleaching process was performed in the manner described in Example 1. The results are shown in Table 2 below.

Table 2

| Series | Additive Substance | Additive kg | Sodium hydroxide batch kg | Sodium hydroxide consump. kg | Kappa No | Viscosity Tappi cP | Brightness Scan % |
|---|---|---|---|---|---|---|---|
| 21 | — | — | 20 | 13 | 15.3 | 81 | 36.9 |
| | | | 30 | 20 | 12.0 | 61 | 43.6 |
| | | | 40 | 28 | 10.1 | 45 | 48.6 |
| | | | 80 | 36 | 6.6 | 21 | 59.1 |
| 22 | Form-aldehyde | 9 | 2C | 15 | 19.0 | 146 | 34.3 |
| | | | 30 | 23 | 14.8 | 109 | 39.4 |
| | | | 40 | 29 | 12.1 | 72 | 43.6 |
| | | | 80 | 44 | 7.4 | 30 | 56.7 |
| 23 | Methanol | 9.6 | 10 | 8 | 19.9 | 121 | 31.7 |
| | | | 20 | 17 | 15.5 | 87 | 37.9 |
| | | | 40 | 31 | 10.2 | 48 | 49.3 |
| | | | 60 | 46 | 8.7 | 36 | 48.4 |
| 24 | Form-aldehyde+ | 0.96 | 10 | 6 | 22.2 | 139 | 30.6 |
| | Methanol | 8.64 | 20 | 13 | 16.2 | 93 | 37.7 |
| | | | 40 | 26 | 9.7 | 49 | 49.0 |
| | | | 60 | 35 | 8.4 | 34 | 55.0 |
| 25 | Formic acid+ | 1.47 | 10 | 6 | 22.2 | 139 | 30.1 |
| | Methanol | 8.64 | 20 | 13 | 15.0 | 89 | 37.3 |
| | | | 40 | 26 | 9.8 | 47 | 49.6 |
| | | | 60 | 33 | 7.6 | 30 | 56.1 |
| 26 | Acetone | 17.4 | 20 | 14 | 15.9 | 113 | 36.2 |
| 27 | Isopro-panole | 17.4 | 20 | 12 | 16.2 | 89 | 36.7 |
| | | | 40 | 26 | 10.2 | 47 | 47.7 |
| 28 | Ethanol | 13.8 | 20 | 14 | 15.7 | 85 | 37.5 |

EXAMPLE 3

The same pulp as in Example 2 was washed with $SO_2$ water and was treated thereafter with the same additives as in series 22. The results are given in Table 3 below.

Table 3

| Series | Additive Substances | Additive kg | Sodium hydroxide batch kg | Sodium hydroxide consump. kg | Kappa No. | Viscosity Tappi cP | Brightness Scan % |
|---|---|---|---|---|---|---|---|
| 32 | Form-aldehyde | 9 | 10 | 6 | 25.9 | (1242)+ | 30.1 |
| | | | 20 | 15 | 18.9 | (1208)+ | 36.1 |

Table 3-continued

| Series | Additive Substances kg | Sodium hydroxide batch kg | Sodium hydroxide consump. kg | Kappa No. | Viscosity Tappi cP | Brightness Scan % |
|---|---|---|---|---|---|---|
| | | 40 | 27 | 10.8 | 76 | 50.6 |
| | | 60 | 33 | 8.2 | 54 | 58.0 |

+cm³/g according to Scan. The values are higher than 180 cP according to Tappi.

The purpose of the bleaching is naturally to give low lignin content or high brightness. The brightness values recorded here are therefore of certain interest, but this is secondary since the brightness in industrial production also depends on the continued treatment. The results from the the laboratory bleaching processes show that the brightness of oxygen bleached pulp can be related to the lignin content in the pulp. $SO_2$ washed pulp has, however, greater brightness with the same lignin content. In reality, therefore, the aim is low kappa number, i.e., lignin content, with high viscosity.

The viscosity desired may vary. For most applications, however, it should be higher than 60 cP, or higher than 80 cP if a high strength is desired.

In order to facilitate an evaluation of the results the kapp number and viscosity from some of the experiment series of the examples have been converted to curves according to FIGS. 2 and 3. FIG. 2 shows the result of experiments series 11 and 12 in Example 1. By way of comparison a curve 01 has also been drawn which shows normal results when a sulphate pulp is oxygen bleached without $SO_2$ washing or the addition of magnesium or formaldehyde.

FIG. 3 shows the result of experiments series 21, 22 and 32 recorded in Examples 2 and 3. The pulp used here had particularly high viscosity, which also resulted in higher viscosity being obtained for a certain kappa number after the oxygen bleaching. Prior experiments with this pulp showed that an increase in the amount of magnesium from 0.46 kg to 0.92 kg per ton pulp gave a maximum of 0.5 units lower kappa number, compared at the same viscosity. Higher quantities of added magnesium gave even more positive effect.

It can be seen from Table 1 and FIG. 2 that even an addition of 3 kg formaldehyde gives noticeable effect, and that this effect can be improved successively up to 24 kg per ton pulp or more, i.e., up to 30 kg per ton but that the greater part of the effect may be considered to have been gained with an addition of about 9 kg per ton pulp. Furthermore, it can be seen that formaldehyde appears to be superior to the other compounds having an equivalent reaction to formaldehyde.

Similarly, it can be seen from Table 2 and FIG. 3 that the effect of formaldehyde, and substances having an equivalent reaction, remains when greater quantities of magnesium are added and the initial pulp has high viscosity. It should be pointed out that the formaldehyde can be replaced by formic acid, particularly if combined with methanol.

Table 3 shows that a particularly satisfactory effect can be achieved by using a combination of magnesium and formaldehyde, if the pulp has first been washed with $SO_2$. However, it would probably be difficult to wash the pulp as thoroughly in large scale production as in the laboratory; i.e., it is uncertain whether the results would be commensurate with the costs.

It can be seen from FIGS. 2 and 3 that the addition of formaldehyde results in curves having a considerably greater inclination than have the other curves. All curves naturally coincide at the viscosity and kappa number of the initial pulp, i.e. the inclination has been correspondingly lower during the first period of the bleaching process. It has also been ascertained that the formaldehyde has been entirely consumed in all the experiments performed in the laboratory, and probably at an early stage of the process. In large scale operation it might therefore be advisable to add the formaldehyde, or the equivalent compounds, gradually during the bleaching process. Such extra additions of formaldehyde, or equivalent compounds, should preferably be made through the tubes 49 in the bottom portion of the apparatus of FIG. 1.

The results obtained also indicate that it is particularly advantageous for the initial pulp to have high viscosity prior to the oxygen bleaching process.

What is claimed is:

1. In a method for bleaching alkaline cellulose pulp with oxygen, the improvement which comprises adding formaldehyde to the pulp during the bleaching process in an amount from 3 to 30 kg per ton of pulp.

2. The method of claim 1 wherein at least a part of the formaldedhyde is added gradually during the bleaching process.

3. The method of claim 1 wherein a water soluble magnesium salt is added to the pulp prior to the bleaching process.

4. The method of claim 3 wherein the amount of magnesium salt added is from 0.5 to 2.0 kg (as mg) per ton of pulp.

5. The method of claim 1 wherein the amount of formaldehyde added is from 6 to 9 kg per ton of pulp and the pulp has a solids content from 25 to 30 % by weight.

6. A method of bleaching cellulose pulp with oxygen comprising creating an upward column of pulp, adding alkaline pulp to the top of the column, adding oxygen to the top of the column, adding formaldehyde to the top of the column and then withdrawing bleached pulp from the bottom of the column.

7. The method of claim 6 comprising adding an additional quantity of oxygen to the bottom of the column.

8. The method of claim 6 comprising adding an additional quantity of formaldehyde to the bottom of the column.

9. A method of bleaching cellulose pulp with oxygen, comprising creating an upright column of pulp, adding pulp to the top of the column, said pulp containing alkali in a quantity of 10–100 kg per ton pulp and having a solids content of 25–35% by weight and a temperature of 80°–120° C, adding oxygen to the top of the column at a rate to maintain in the column a pressure of 0.5–1.5 MPa, adding formaldehyde to the top of the column, adding water to the bottom of the column to form diluted pulp by reducing the solids content of the pulp to 3–5 % by weight, and then withdrawing bleached and diluted pulp from the bottom of the column.

10. The process of claim 1 wherein the amount of formaldehyde added is from 3 to 24 kg per ton of pulp.

* * * * *